US006709282B2

(12) United States Patent
Sugiyama

(10) Patent No.: US 6,709,282 B2
(45) Date of Patent: Mar. 23, 2004

(54) WATERPROOF CONNECTOR

(75) Inventor: Osamu Sugiyama, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/206,950

(22) Filed: Jul. 30, 2002

(65) Prior Publication Data

US 2003/0027454 A1 Feb. 6, 2003

(30) Foreign Application Priority Data

Jul. 31, 2001 (JP) ..... P 2001-232111

(51) Int. Cl.[7] ..... H01R 13/52
(52) U.S. Cl. ..... 439/275; 439/274; 439/587
(58) Field of Search ..... 439/274, 275, 439/279, 272, 587, 588, 421, 877, 865, 866, 884

(56) References Cited

U.S. PATENT DOCUMENTS 4,391,483 A * 7/1983 Desourteaux ..... 439/271
5,519,170 A * 5/1996 Nabeshima ..... 174/74 R
5,564,946 A * 10/1996 Kodama ..... 439/587
5,607,318 A * 3/1997 Wakata et al. ..... 439/274
5,611,706 A * 3/1997 Makita et al. ..... 439/275
6,059,594 A * 5/2000 Davis et al. ..... 439/275

FOREIGN PATENT DOCUMENTS

JP 7-245149 9/1995

* cited by examiner

*Primary Examiner*—Tho D. Ta
(74) *Attorney, Agent, or Firm*—Finnegan, Henderson, Farabow, Garrett & Dunner, L.L.P.

(57) ABSTRACT

A waterproof connector is provided with one or more terminals each including a contact, a first crimp portion and a second crimp portion, insulated cables respectively having leading conductor clamped by the first crimp portion, rubber plugs respectively fitted on the insulated cable, being clamped by the second crimp portion and a connector housing including terminal housing chambers respectively housing the terminals. The rubber plugs are fitted into the respective terminal housing chambers so as to be waterproof. Each of the second crimp portions has a larger width than height thereof in a state where the second crimp portion clamps the rubber plug.

2 Claims, 4 Drawing Sheets

WATERPROOF CONNECTOR

BACKGROUND OF THE INVENTION

1. Field of the Invention

The present invention relates to a waterproof connector in which watertightness is not easily reduced due to an inappropriate installation process.

2. Description of the Related Art

There is proposed a waterproof connector which is provided with a connector housing having a plurality of terminal housing chambers for receiving metal terminals. A metal terminal is provided with first and second crimp portions. The first crimp portion clamps an insulated cable to electrically contact and the second crimp portion clamps a rubber plug. When the metal terminal is received in the terminal housing chamber, the rubber plug is fitted thereto so as to be watertight.

Japanese patent application laid-open H7-245149 discloses such an art of the proposed waterproof connector.

SUMMARY OF THE INVENTION

According to the proposed waterproof connector, the inner diameter A of the terminal housing chambers is secured to be large enough as compared to the outer diameter B of the insulated cable so that clearance between the first crimp portion clamping the insulated cable and the terminal housing chamber is assured. Thereby the first crimp portion may not scratch an inner surface of the terminal housing chamber in the course of the waterproof connector assembly.

However, if the inner diameter A is relatively small due to miniaturization of the waterproof connector, an appropriate clearance between the first crimp portion and the terminal housing chamber is not assured, the terminal housing chamber may be often scratched, then reducing watertightness.

The present invention is accomplished in view of the above problem and intends to provide a waterproof connector of a small-size, watertightness of which is not easily reduced due to an inappropriate installation process.

According to the present invention, the waterproof connector is provided with one or more terminals each including a contact, a first crimp portion and a second crimp portion, insulated cables respectively having leading conductor clamped by the first crimp portion, rubber plugs respectively fitted on the insulated cable, being clamped by the second crimp portion and a connector housing including terminal housing chambers respectively housing the terminals. The rubber plugs are fitted into the respective terminal housing chambers so as to be waterproof. Each of the second crimp portions has a larger width than height thereof in a state where the second crimp portion clamps the rubber plug.

A top end or a bottom end of the second crimp portion may cause scratches to the terminal housing chamber because the top end and the bottom end often have burrs due to the manufacturing process thereof. Each of the second crimp portions is formed to have a larger width than height thereof so that clearance between the top and bottom end thereof and the terminal housing chamber are broad enough to avoid scratching the terminal housing chamber. Thereby excellent watertightness is assured.

More preferably, the terminal housing chambers are respectively formed in a cylindrical hollow shape and sizes of the terminal housing chambers and the terminals are formed to satisfy the following inequalities;

$$B/A>0.6 \text{ and } D/C<1,$$

where A is an inner diameter of the terminal housing chamber, B is an outer diameter of the insulated cable, C, D are respectively the width and height of the second crimp portion in a state where the second crimp potion clamps the rubber plug.

Miniaturizing the connector makes a B/A ratio larger to be close to 1. In a case where the B/A ratio is more than 0.6, scratching is highly likely to happen. Because the D/C ratio is kept at less than 1 in such a case, scratching is avoided and watertightness is assured.

Further preferably, each of the second crimp portions has an oval cylinder shape in a state where the second crimp portion clamps the rubber plug. The rounded shape prevents the second crimp portions from scratching the terminal housing chamber.

DETAILED DESCRIPTION OF THE PREFERRED EMBODIMENT

Figure 1:
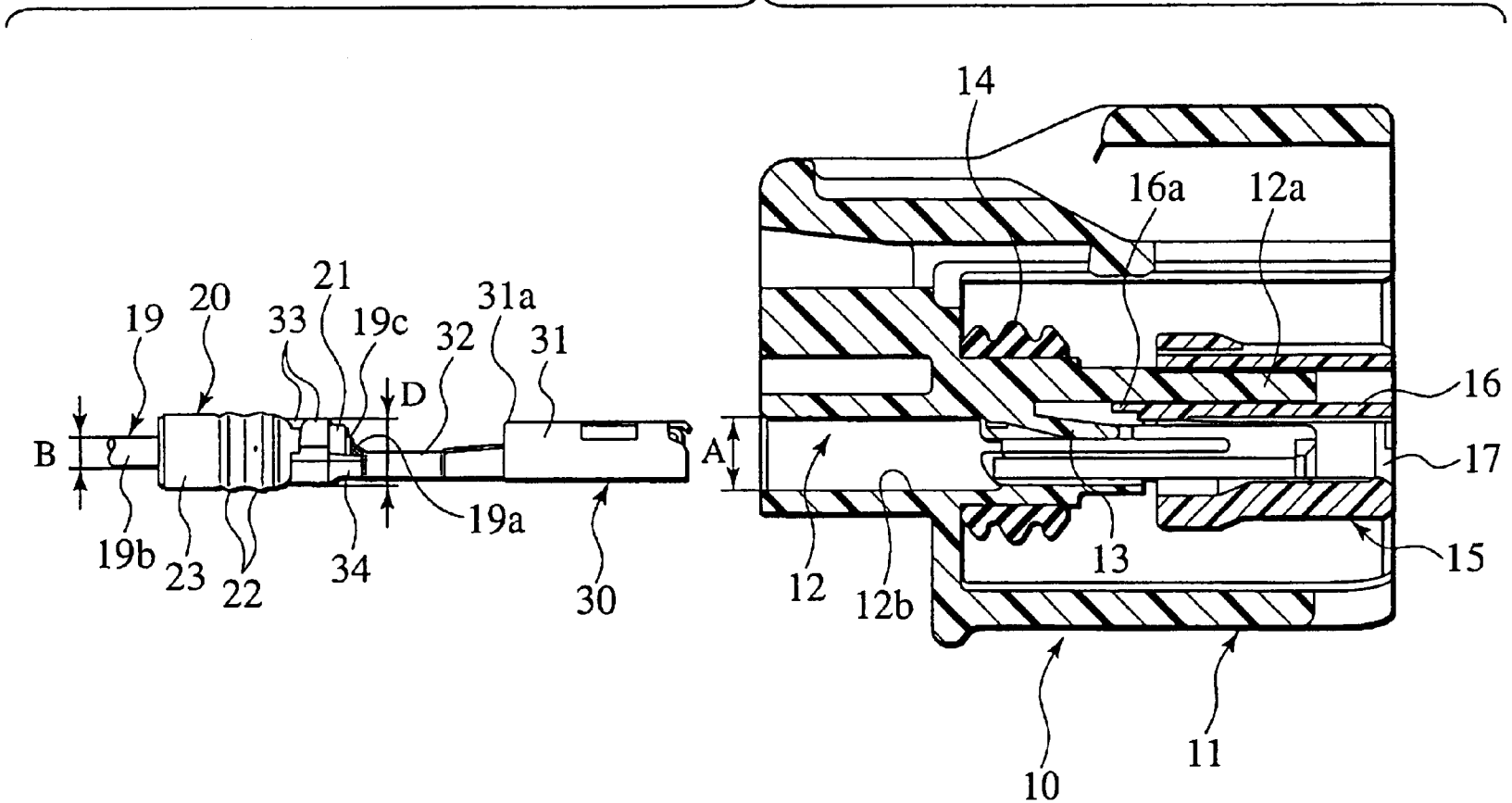
FIG. 1 is a cross-sectional view of a waterproof connector according to an embodiment of the present invention.
Figure 2:
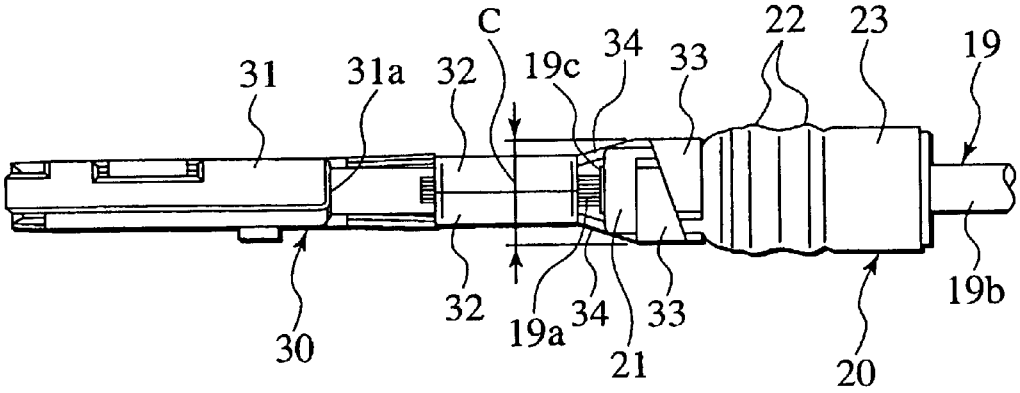
FIG. 2 is a plan view of the terminal of the waterproof connector.
Figure 3:
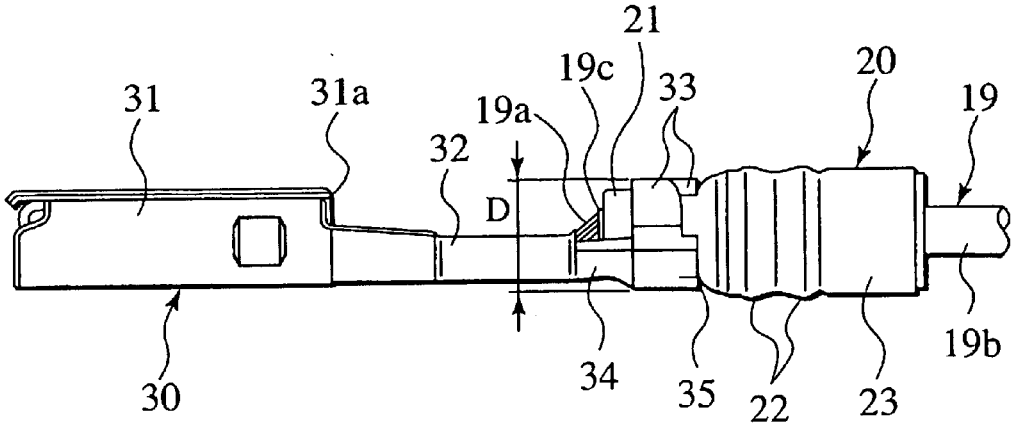
FIG. 3 is a side view of the terminal of the waterproof connector.

A preferred embodiment of the present invention will be described hereinafter with reference to FIGS. 1 to 6.

The waterproof connector 10 is provided with a connector housing 11 which is made of resin and has a box-like shape. A plurality of terminal housing chambers 12 penetrate the connector housing 11 from a front end to a rear end thereof. A front half of the respective terminal housing chamber 12 is surrounded by a circumferential wall 12*a* to be of a rectangular tube shape and a rear half is surrounded by a sealing surface 12*b* to be of a cylindrical tube shape.

An insulated cable 19 with a rubber plug 20 fitted thereto is inserted to a rear end of the terminal housing chamber 12. The rubber plug 20 is in close contact with the sealing surface 12*b* so that the terminal housing chamber 12 is assured to be watertight.

Each terminal housing chamber is integrally provided with a resilient latch arm 13 diagonally extending from an upper surface thereof to a front end of the terminal housing chamber 12 so that a main body 31 of a terminal 30 housed in the circumferential wall 12*a* of the terminal housing chamber 12 is engaged therewith. Circular rubber packings 14 are respectively fitted to outer surfaces of the circumferential walls 12*a*. Tubular spacers 15 are respectively slidably fitted into the circumferential walls 12*a* so as to press the circular rubber packings 14. The tubular spacers 15 are made of synthetic resin and formed in a box-like shape. Each tubular spacer 15 is provided with a barrier wall 16 and an end portion 16*a* of the barrier wall 16 is in contact with a proximal end of the respective resilient latch arm 13 so as to prevent upward elastic deformation. Thereby the terminals 30 are doubly latched with the resilient latch arms 13 and the tubular spacers 15. The tubular spacers 15 are respectively provided with rectangular apertures 17 corresponding to the terminal housing chambers 12 for receiving opposite terminals (not shown).

Figure 5:
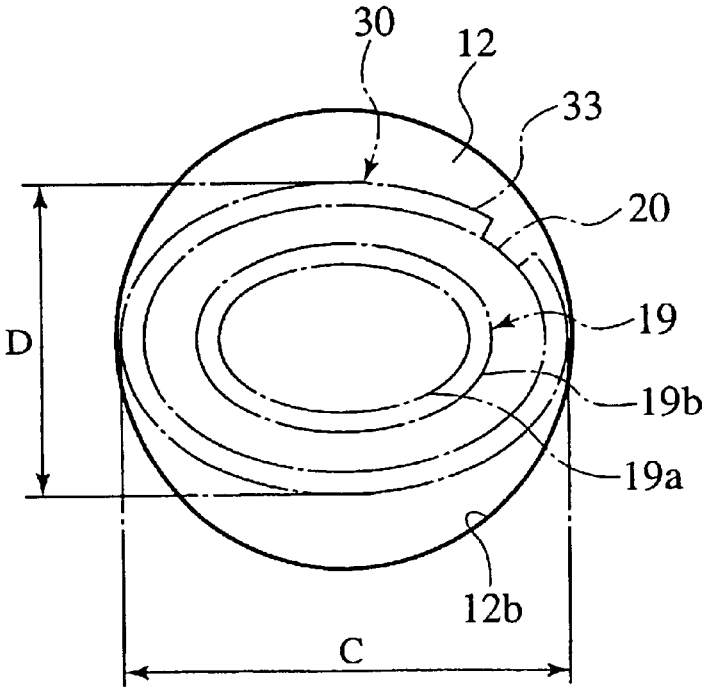
FIG. 5 is an explanation drawing explaining the relationship of the second crimp portion and a terminal housing chamber of the connector.
Figure 6:
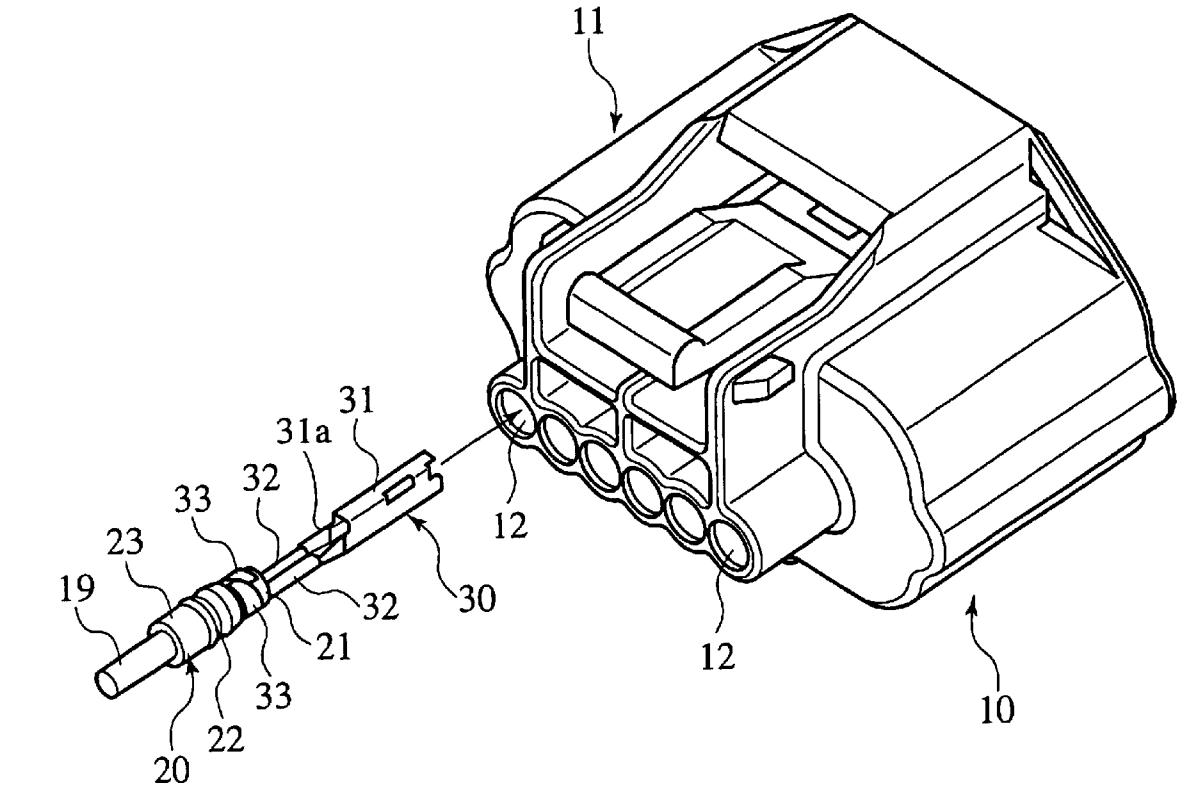
FIG. 6 is a perspective view of the waterproof connector in a state where the terminal is ready to be housed therein.

The insulated cable 19 is composed of a conductor 19*a* and an insulation sheath 19*b* covering the conductor 19*a* as shown in FIG. 5. An end of the insulation sheath 19*b* is removed and an end of the conductor 19*a* is exposed. The leading conductor 19*a* is clamped by a first crimp portion 32 of a terminal 30 (to be described later).

The rubber plug 20 is integrally provided with a connection portion 21 for attaching to a second crimp portion 33 of the terminal 30, a sealing portion 22 having a plurality of torus-like portions for closely contacting the sealing surface 12*b* of the terminal housing chamber 12 and a proximal portion 23 for closely contacting with a peripheral surface of the insulated cable 19. The sealing portion 22 and the proximal portion 23 have larger diameter than the sealing surface 12*b* of the terminal housing chamber 12.

Figure 4:
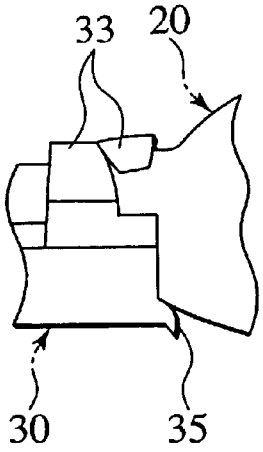
FIG. 4 is a close-up side view of the terminal of the waterproof connector showing the vicinity of a second crimp portion thereof.

The terminal 30 is provided with a contact 31 having a rectangular tube-like shape at a proximal end thereof, a first crimp portion 32 having a pair of crimp arms for clamping the conductor 19*a*, a second crimp portion 33 having a pair of crimp arms for clamping the connection portion 21 of the rubber plug 20. Both sides of the first crimp portion 32 and the second crimp portion 33 are integrally connected by a pair of side walls 34. The terminal 30 is inserted into the terminal housing chamber 12 from the rear end thereof so that a proximal end 31*a* of the contact 31 is latched by a distal end of the resilient latch arm 13. The whole body of the terminal 30 is made from a blanked metal sheet (not shown). A metal sheet is blanked and bent in a predetermined shape of the terminal 30, therefore it rarely happens that burrs 35 are formed due to production tolerance as shown in FIG. 4. The burrs 35 often cause scratching the sealing surface 12*b*.

Width C of the second crimp portion 33 clamping the connection portion 21 is larger than height D thereof as shown in FIG. 5. More specifically, the terminal 30 is formed so that an inequality D/C<1 is assured to be satisfied whenever an inequality B/A>0.6 is satisfied, where A is an inner diameter of the sealing surface 12*b* of the terminal housing chamber 12 and B is an outer diameter of the insulated cable 19.

For example, a compact waterproof connector 10 is formed so that A is 2.6 mm, B is 1.8 mm, C is 2.3 mm and D is 2.1 mm. In such a case, B/A=0.69>0.6 and D/C=0.91<1 are satisfied. Though the inner diameter A of the terminal housing chamber 12 can be smaller, the outer diameter B of the insulated cable 19 may be limited. Therefore miniaturizing the connector makes a B/A ratio larger to be close to 1. In a case where the B/A ratio is more than 0.6, scratching of the sealing surface 12*b* by the terminal 30 is highly likely to happen. The critical ratio of B/A=0.6 is determined by the above consideration.

Furthermore, a width and a height of the contact 31 are respectively smaller than the width C and the height D of the second crimp portion 33, thereby the waterproof connector 10 is formed smaller. The width C of the second crimp portion 33 is smaller than the inner diameter A of the sealing surface 12*b* of the terminal housing chamber 12.

According to the above described embodiment of the present invention, the waterproof connector 10 is formed so that the inequality D/C<1 is assured to be satisfied whenever the inequality B/A>0.6 is satisfied, where A is the inner diameter of the sealing surface 12*b* of the terminal housing chamber 12, B is the outer diameter of the insulated cable 19, C is the width of the second crimp portion 33 and D is the height of the second crimp portion 33. Thereby the crimp portion 33, the burrs 35 and such do not easily scratch the sealing surface 12*b* of the terminal housing chamber 12 in course of inserting the terminal 30.

The height of the terminal 30 slightly has some variation due to a production error because the blanking burrs stand in a vertical direction and the terminal 30 is easy to be bent upward or downward. Moreover, the terminal 30 is often inserted into the terminal housing chamber 12 in a slanted direction. The width C of the second crimp portion 33 is larger than the height D thereof so that a considerable clearance between the second crimp portion 33 and the sealing surface 12*b* is assured to prevent scratching. On the contrary, the width of the terminal 30 is formed more precisely than the height thereof.

As described above, the sealing surface 12*b* is not easily to be scratched and the rubber plug 20 can be in close contact thereto, thereby excellent watertightness is assured.

Although the invention has been described above by reference to certain embodiments of the invention, the invention is not limited to the embodiments described above. Modifications and variations of the embodiments described above will occur to those skilled in the art, in light of the above teachings. For example, according to the above description, the crimp portions are bent in an oval tube as shown in FIG. 5. The crimp portions may be bent in a rectangular tube instead.

What is claimed is:

1. A waterproof connector comprising:

one or more terminals, each terminal including a contact, a first crimp portion, and a second crimp portion;

one or more insulated cables, each insulated cable being associated with one of the terminals and having a leading conductor clamped by the first crimp portion;

one or more rubber plugs, each rubber plug being associated with one of the insulated cables and being fitted on the insulated cable, and each rubber plug being clamped by the second crimp portion of the terminal associated with the insulated cable; and a connector housing including one or more terminal housing chambers having a substantially cylindrical hollow shape for housing the terminals, each rubber plug being fitted therein so as to be waterproof;

each of the second crimp portions having a larger width than a height thereof in a state where the second crimp portion clamps over the rubber plug, wherein an inner diameter (A) of the terminal housing chamber, an outer diameter (B) of the insulated cable, and a width (C) and a height (D) of the second crimp portion in a state where the second crimp portion clamps the rubber plug, satisfy the following inequalities:

$$(B)/(A)>0.6 \text{ and } (D)/(C)<1.$$

2. The waterproof connector according to claim 1, wherein:

each of the second crimp portions has an oval cylinder shape in a state where the second crimp portion clamps the rubber plug.

* * * * *